US007580050B2

(12) United States Patent
Kim et al.

(10) Patent No.: US 7,580,050 B2
(45) Date of Patent: Aug. 25, 2009

(54) PLASMA DISPLAY DEVICE AND DRIVING METHOD THEREOF

(75) Inventors: Tae-Seong Kim, Suwon-si (KR); Woo-Joon Chung, Suwon-si (KR); Jin-Sung Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 628 days.

(21) Appl. No.: 11/255,868

(22) Filed: Oct. 24, 2005

(65) Prior Publication Data

US 2006/0087481 A1 Apr. 27, 2006

(30) Foreign Application Priority Data

Oct. 25, 2004 (KR) ..... 10-2004-0085250

(51) Int. Cl.
*G09G 3/28* (2006.01)

(52) U.S. Cl. ..... 346/60; 345/63; 345/66

(58) Field of Classification Search ..... 345/63, 345/60, 67

See application file for complete search history.

(56) References Cited

U.S. PATENT DOCUMENTS

| | | | | |
|---|---|---|---|---|
| 5,745,086 | A | 4/1998 | Weber | |
| 6,236,165 | B1 | 5/2001 | Ishizuka | |
| 6,373,452 | B1 * | 4/2002 | Ishii et al. | 345/67 |
| 6,512,501 | B1 | 1/2003 | Nagaoka et al. | |
| 2002/0050960 | A1 * | 5/2002 | Setoguchi et al. | 345/60 |
| 2003/0107532 | A1 * | 6/2003 | Choi | 345/60 |
| 2003/0234753 | A1 * | 12/2003 | Tanaka | 345/67 |
| 2005/0174304 | A1 | 8/2005 | Kim et al. | |

FOREIGN PATENT DOCUMENTS

| | | |
|---|---|---|
| CN | 1519808 | 8/2004 |
| CN | 1532786 | 9/2004 |
| EP | 1 418 563 A1 | 5/2004 |
| JP | 2000-148083 | 5/2000 |
| JP | 2000-215813 | 8/2000 |

(Continued)

OTHER PUBLICATIONS

Non-Final Office Action dated Jan. 8, 2008 (for U.S. Appl. No. 10/911,383).

*Primary Examiner*—Amare Mengistu
*Assistant Examiner*—Koosha Sharifi
(74) *Attorney, Agent, or Firm*—H.C. Park & Associates, PLC

(57) ABSTRACT

In a driving method of a plasma display device, a final voltage of a falling ramp voltage is set to a discharge firing voltage of all the discharge cells after applying a gradually rising ramp voltage during a reset period. A difference in voltage applied to an address electrode and to a scan electrode is set to be greater than the maximum discharge firing voltage in turn-on discharge cells in an address period. A bias voltage applied in a rising reset period, an address period, and a sustain period of subfields that express low grayscales is increased, and the address electrode is biased with a positive voltage in the sustain period. With this configuration, the problem of worsening the margins by loss of wall charges is solved since addressing is not influenced by the wall charges and performance of expressing low grayscales is increased.

15 Claims, 9 Drawing Sheets

FOREIGN PATENT DOCUMENTS

| | | | |
|---|---|---|---|
| JP | 2000-242222 | | 9/2000 |
| JP | 2001-184024 | | 7/2001 |
| JP | 2001-228820 | | 8/2001 |
| JP | 2001-228821 | | 8/2001 |
| JP | 2001-272947 | | 10/2001 |
| JP | 2002-014652 | | 1/2002 |
| JP | 2003-255888 | | 9/2003 |
| JP | 2003-302930 | | 10/2003 |
| KR | 1999-013884 | A1 | 2/1999 |
| KR | 1020040000327 | A1 | 1/2004 |

* cited by examiner

PLASMA DISPLAY DEVICE AND DRIVING METHOD THEREOF

CROSS REFERENCE TO RELATED APPLICATION

This application claims priority to and the benefit of Korean Patent Application No. No. 10-2004-0085250, filed on Oct. 25, 2004, which is hereby incorporated by reference for all purposes as if fully set forth herein.

BACKGROUND OF THE INVENTION

1. Field of the Invention

The present invention relates to a plasma display device and a driving method thereof.

2. Discussion of the Background

A plasma display device is a flat panel display that uses plasma generated by a gas discharge process to display characters or images. It includes, depending on its size, more than several scores to millions of pixels arranged in a matrix pattern.

According to a typical plasma display device, each frame is divided into a plurality of subfields, and each subfield has a reset period, an address period, and a sustain period.

In the reset period, wall charges formed by a previous sustain discharge are erased, and new wall charges are set up so that the next addressing can be stably performed.

In the address period, a scan pulse is applied to a scan electrode and an address voltage is applied to an address electrode such that turn-on cells (i.e., cells to be turned on) are selected and wall charges accumulate to the turn-on cells (i.e., addressed cells).

In the sustain period, a sustain voltage causes the addressed cells to discharge, thus displaying an image.

According to a conventional driving method, the addressing is sequentially performed on all the scan electrodes in the address period to create an internal wall voltage. However, the internal wall voltages of the scan electrodes that are selected in the earlier stages may be reduced, which results in reduced margins.

In addition, a reset discharge is weak and thus light generated from the reset discharge is ignored. Therefore, a subfield with a weight value of 1 for expressing a gray scale 1 is represented by address light generated from an address discharge and sustain light generated from a sustain discharge. However, a brightness level of the minimum unit of light (minimum sustain light) generated from the sustain discharge is excessively high to express a low gray scale according to the conventional driving method. The information disclosed in this Background of the Invention section is only for enhancement of understanding of the background of the invention, and therefore, unless explicitly described to the contrary, it should not be taken as an acknowledgement or any form of suggestion that this information forms the prior art that is already known in this country to a person of ordinary skill in the art.

SUMMARY OF THE INVENTION

This invention provides a plasma display device, and a driving method for the same, for performing addressing using less internal wall voltage.

The present invention also provides a plasma display device, and a driving method for the same, for increasing the performance of expressing low grayscales.

Additional features of the invention will be set forth in the description which follows, and in part will be apparent from the description, or may be learned by practice of the invention.

The present invention discloses a driving method of a plasma display device by a plurality of subfields divided from a frame, where the plasma display device has a plurality of first, second, and address electrodes that form discharge cells. The plasma display device expresses gray scales by using combinations of subfields that have respective weight values, and the subfields are grouped into first and second groups, where the first group of subfields includes those subfields with a minimum weight value. The driving method comprises the steps of gradually reducing a voltage at the first electrode from a first voltage to a second voltage during a reset period, applying at least one scan pulse to an electrode selected from the plurality of first electrodes and simultaneously applying an address voltage to an address electrode of a discharge cell from among discharge cells applied with the scan pulse during an address period, and gradually increasing the voltage of the first electrode from a third voltage to a fourth voltage in a sustain period.

The present invention also discloses a plasma display panel with a plurality of first second, and third electrodes, where the third electrodes cross the first and second electrodes to form discharge cells, and the plasma display device also includes a controller and a driver. The controller divides a frame into a plurality of subfields having respective weight values, categorizes the subfields into a first group and a second group, where the first group includes the subfields with a minimum weight value, and controls the subfields. The driver gradually reduces the voltage difference between the first and second electrodes during a reset period of each subfield, where the voltage difference being obtained by subtracting a voltage of the second electrode from a voltage of the first electrode. In addition, the driver gradually increases the voltage difference from a third voltage to a fourth voltage, during a sustain period of the first group.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
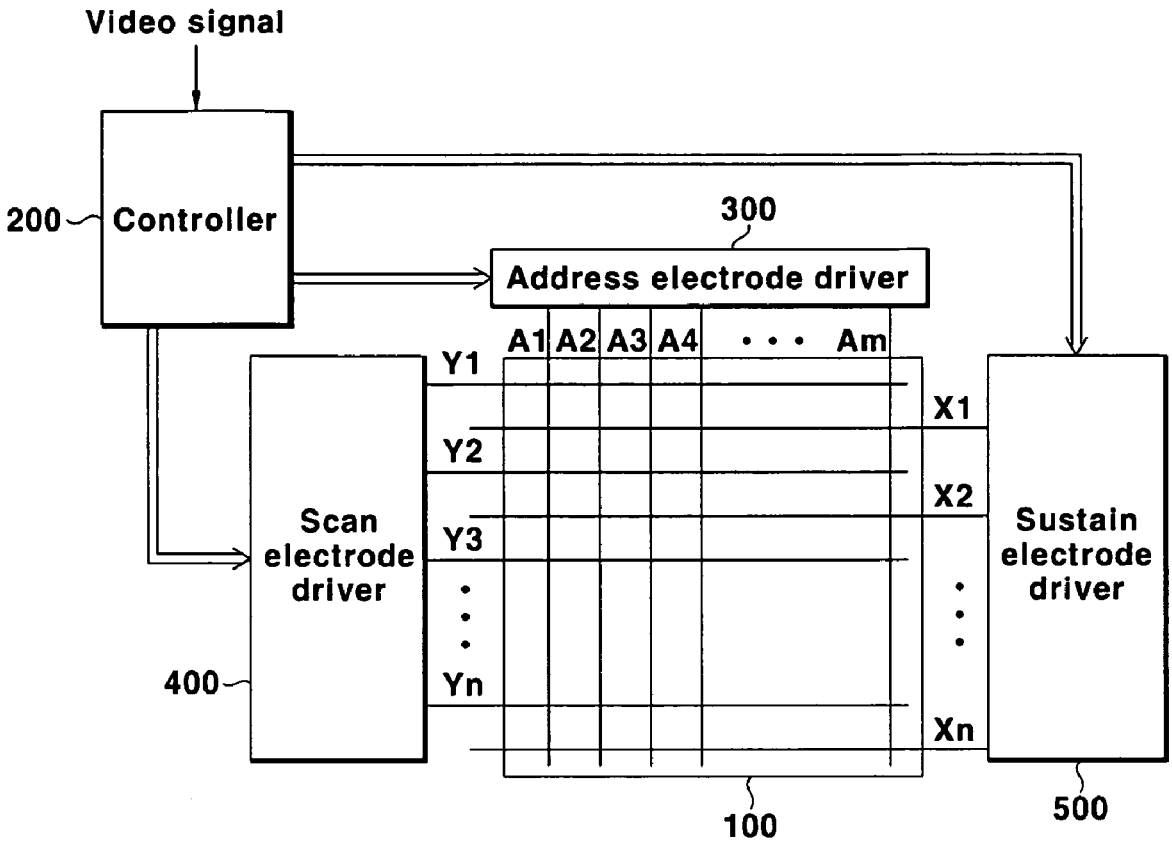
FIG. 1 is a schematic view of a plasma display device according to an embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity.

Notations of reference numerals as address electrodes $A_1$-$A_m$, scan electrodes $Y_1$-$Y_n$, or sustain electrodes $X_1$-$X_n$ represent that the same voltage is applied to all the stated electrodes, and notations of reference numerals as address electrodes $A_i$ and scan electrodes $Y_j$ represent that a corresponding voltage is applied to only those electrodes expressly referenced. Notation of voltage differences such as $V_{A\text{-}Y,reset}$, for example, represents the voltage difference between the A and Y electrodes during the reset period. Discharge firing voltages are noted as $V_f$, and additional subscripts may be added to further describe the two electrodes between which discharge is occurring. In the following detailed description, discharge cells shall include discharge cells which are formed at an area that may influence a display on a screen of the PDP.

FIG. 1 is a schematic view of a plasma display device according to an embodiment of the present invention. As shown in FIG. 1, the plasma display device includes a plasma display panel 100, a controller 200, an address electrode driver 300, a scan electrode driver 400, and a sustain electrode driver 500.

The plasma display panel 100 includes a plurality of address electrodes A1-Am elongated in a column direction and a plurality of sustain and scan electrodes X1-Xn and Y1-Yn elongated in a row direction by pairs. In general, the respective sustain electrodes X1-Xn are placed facing each other, and the address electrodes A1-Am perpendicularly cross the scan electrodes Y1-Yn and the sustain electrodes X1-Xn. A discharge space is formed at a region where the address electrodes A1-Am cross the sustain and scan electrodes X1-Xn and Y1-Yn, and such a discharge space forms a cell.

The controller 200 externally receives a video signal and outputs a driving control signal. In addition, the controller divides one frame into a plurality of subfields having respective luminance weights, and each subfield includes a reset period, an address period, and a sustain period according to time-based operational changes. The address electrode driver 300, the scan electrode driver 400, and the sustain electrode driver 500 apply driving voltages to the address electrodes A1-Am, the sustain electrodes X1-Xn, and the scan electrodes Y1-Yn, respectively, according to the driving control signal from the controller 200.

The address electrode driver 300 receives an address driving control signal from the controller 200, and applies a display data signal for selecting turn-on cells (i.e., discharges to be turned on) to the address electrodes A1-Am.

The scan electrode driver 400 receives a scan electrode driving control signal from the controller 200, and applies a driving voltage to the scan electrodes Y1-Yn.

The sustain electrode driver 500 receives a sustain electrode driving control signal from the controller 200, and applies a driving voltage to the sustain electrodes X1-Xn.

A driving method of a plasma display device according to a first embodiment of the present invention will now be described in more detail with reference to FIG. 2.

Figure 2:
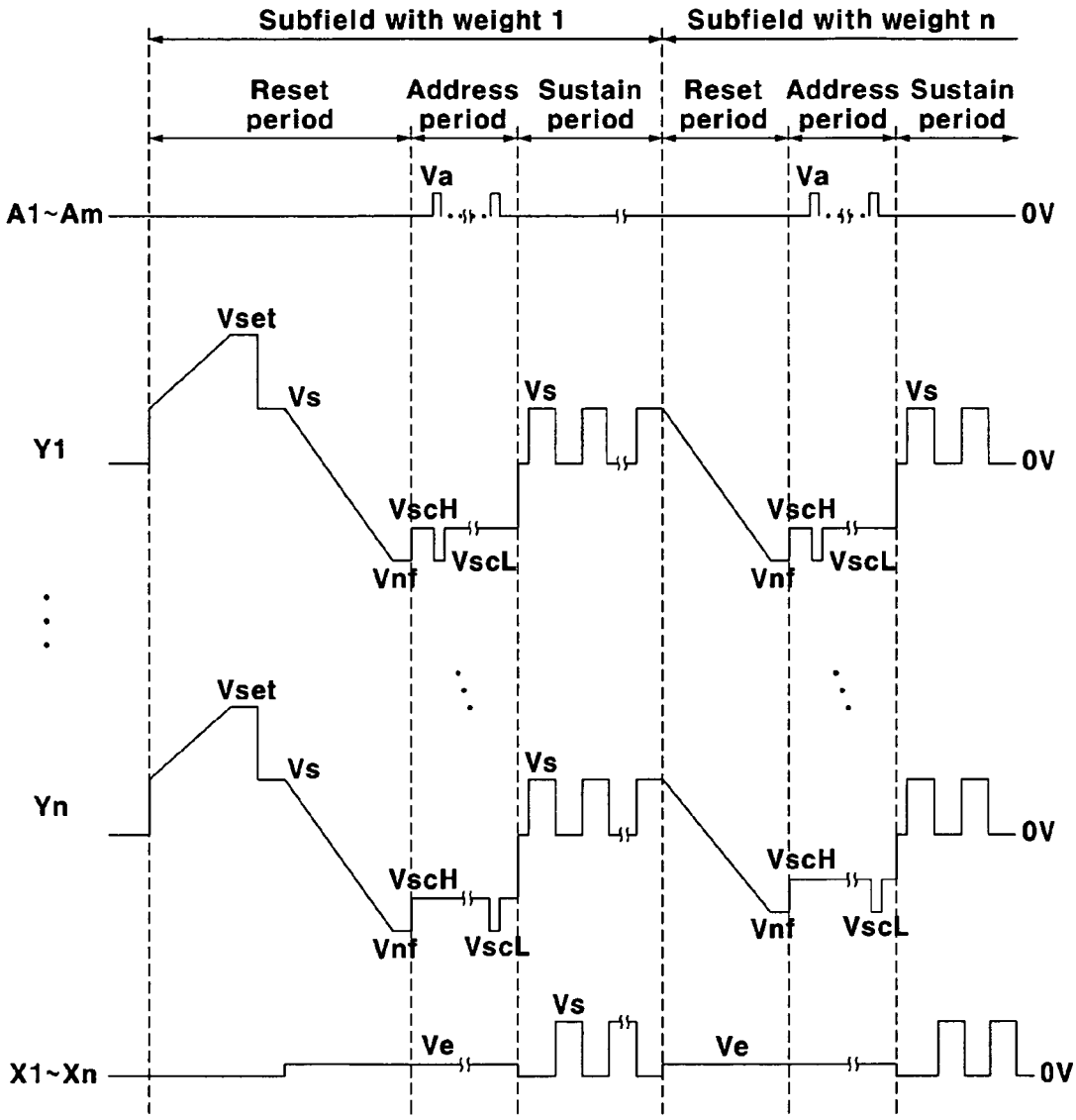
FIG. 2 shows a driving waveform diagram according to a first embodiment of the present invention.

FIG. 2 is a driving waveform diagram of the plasma display device according to the first embodiment of the present invention.

As shown in FIG. 2, the driving waveform according to the first embodiment of the present invention includes a reset period, an address period, and sustain period. A scan/sustain driving circuit (not shown) applying driving voltages to scan electrodes $Y_1$-$Y_n$ and sustain electrodes $X_1$-$X_n$ in each period, and an address driving circuit (not shown) applying a driving voltage to address electrodes $A_1$-$A_m$ are coupled to a plasma display panel (PDP). The PDP and the driving circuits coupled thereto configure a plasma display panel.

Wall charges formed in the sustain period are eliminated in the reset period. A reset waveform applied in a reset period of a first subfield (hereinafter, referred to as a main reset waveform) eliminates wall charges accumulated to all the discharge cells, and a reset waveform applied in a reset period of a second subfield (hereinafter referred to as an auxiliary reset waveform) eliminates wall charges accumulated in only the discharge cells selected for turn-on during the first subfield. The address period is for selecting turn-on discharge cells, and the sustain period is for discharging the selected turn-on discharge cells.

When the voltage between the scan electrode and the address electrode or between the scan electrode and the sustain electrode is greater than the discharge firing voltage, a discharge occurs between the scan electrode and the address electrode or between the scan electrode and the sustain electrode.

In the reset period of the first subfield, the main reset waveform is applied and a ramp voltage that gradually rises from voltage $V_s$ to voltage $V_{set}$ is applied to the scan electrodes $Y_1$-$Y_n$. The voltage $V_{set}$ is greater than a discharge firing voltage. Weak discharges are generated between the scan electrode Y and the address electrode A and between the scan electrode Y and the sustain electrode X while the gradually rising ramp voltage is being applied. Negative (−) wall charges are accumulated to the scan electrode Y and positive (+) wall charges are accumulated to the address electrode A by the weak discharges.

Then, a ramp voltage that gradually falls from voltage $V_s$ to voltage $V_{nf}$ is applied to the scan electrode Y. The wall voltage in the discharge cell is reduced by the same gradient as that of the falling ramp voltage when the gradually falling ramp voltage is applied to generate discharges as described in the first embodiment. This principle is disclosed in detail in the U.S. Pat. No. 5,745,086, and therefore is not described in further detail herein.

Next, a reference voltage, for example 0V, is applied to the address electrode A, and the sustain electrode X is biased with voltage $V_e$.

Figure 3:
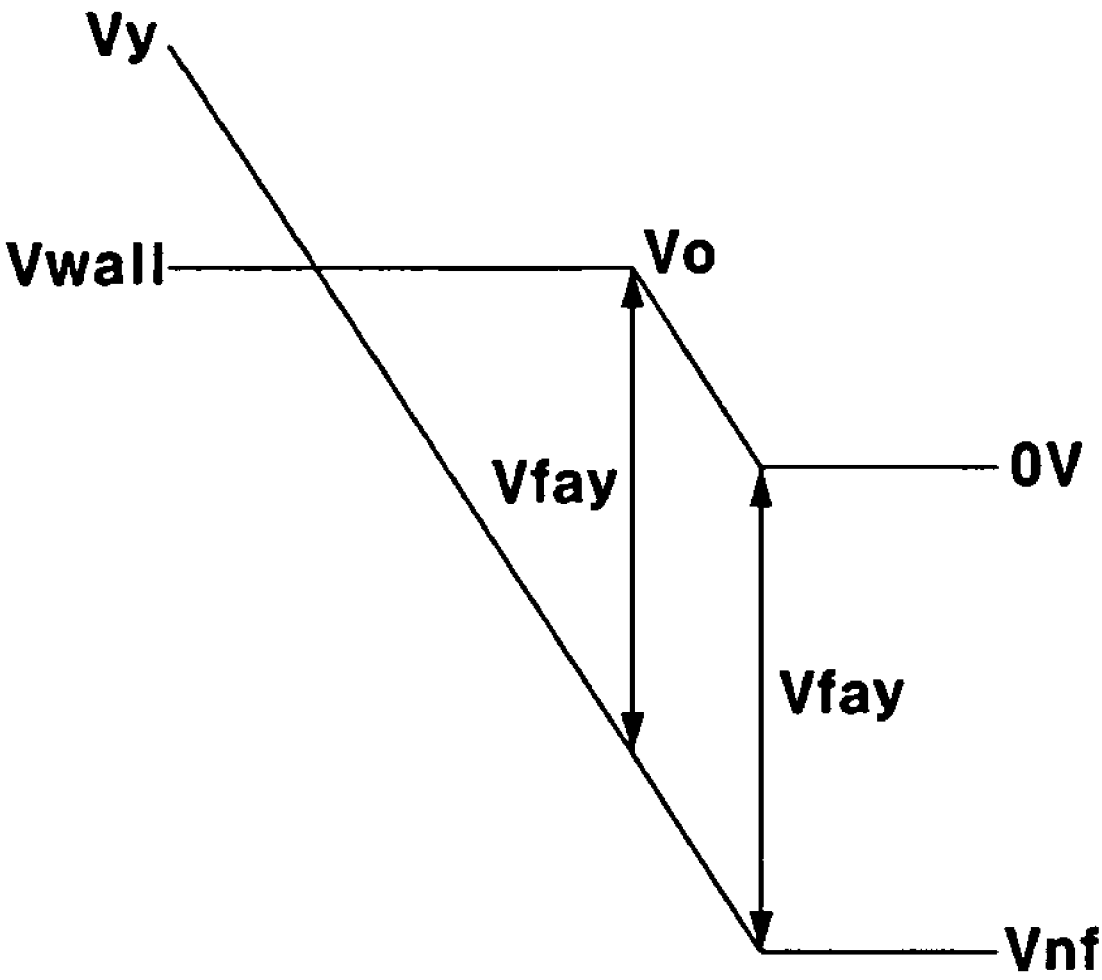
FIG. 3 shows a relationship between a falling ramp voltage and a wall voltage when the falling ramp voltage is applied to a discharge cell.

A discharge characteristic when the ramp voltage falling to voltage $-V_{fay}$ is applied will be described with reference to FIG. 3. FIG. 3 shows a relational diagram between a falling ramp voltage and a wall voltage when the falling ramp voltage is applied to the discharge cells.

Scan electrodes and address electrodes are focused on in FIG. 3, assuming that a predetermined wall voltage $V_o$ is formed since negative and positive charges respectively are accumulated on the scan and address electrodes before the falling ramp voltage is applied.

A discharge is generated when a difference between wall voltage $V_{wall}$ and voltage $V_y$ applied to the scan electrode becomes equal to or greater than the discharge firing voltage $V_{fay}$. As shown in FIG. 3, while the voltage applied to the scan electrode is gradually reduced, and wall voltage $V_{wall}$ in the discharge cell is reduced by the same gradient as that of falling ramp voltage $V_y$ as described above. Thus, the difference between the falling ramp voltage $V_y$ and the wall voltage $V_{wall}$ maintains the discharge firing voltage difference $V_{fay}$. When the discharge firing voltage between the address electrode A and the scan electrode Y is set to be voltage $V_{fay}$, the final voltage $V_{nf}$ of the falling ramp voltage corresponds to a voltage of $-V_{fay}$. Accordingly, the wall voltage $V_{wall}$ between the address electrode and the scan electrode within the discharge cell reaches 0V when the voltage $V_y$ applied to the scan electrode is reduced to voltage $-V_{fay}$.

Since the discharge firing voltage varies according to characteristics of the discharge cells, voltage $V_y$ applied to the scan electrode can be set to allow all the discharge cells to be discharged from address electrodes $A_1$-$A_m$ to scan electrodes $Y_1$-$Y_n$.

That is, as given in the following Equation 1, a difference $V_{A\text{-}Y,reset}$ between voltage 0V applied to address electrodes $A_1$-$A_m$ and voltage $V_{nf}$ applied to scan electrodes $Y_1$-$Y_n$ is set to be greater than or equal to the maximum discharge firing voltage $V_{f,MAX}$ of the discharge cells. To obtain wall voltage of 0V, $|V_{nf}|$ should correspond to the maximum discharge firing voltage $V_{f,MAX}$, since a negative wall voltage can be formed when $|V_{nf}|$ is far greater than the maximum discharge firing voltage $V_{f,MAX}$.

$$V_{A\text{-}Y,reset}=|V_{nf}|\geqq V_{f,MAX} \quad \text{[Equation 1]}$$

Thus, the wall voltage is eliminated from the discharge cells when a ramp voltage which falls to voltage $V_{nf}$, where $V_{nf}$ is equal to discharge firing voltage $V_f$, is applied to scan electrode $Y_1$-$Y_n$. A negative wall voltage may be generated in the discharge cells having discharge firing voltage $V_f$ of less than the maximum discharge firing voltage $V_{f,MAX}$, when $|V_{nf}|$ is equal to the maximum discharge firing voltage $V_{f,MAX}$. Then, the negative wall charges are generated on the address electrodes A1-Am and the scan electrodes Y1-Yn. The generated wall voltage in this instance is a voltage for solving non-uniformity between the discharge cells in the address period.

In the address period, the voltages at scan electrodes $Y_1$-$Y_n$ and sustain electrodes $X_1$-$X_n$ are biased at the reference voltage, for example 0V, and $V_e$ respectively, and voltages are sequentially applied to individual scan electrodes $Y_1$ through $Y_n$. When a voltage is applied to each scan electrode, a voltage is simultaneously applied to the address electrode to select turn-on discharge cells. In more detail, negative voltage $V_{scL}$ is applied to scan electrode $Y_1$ of the first row, and positive voltage $V_a$ is applied to every address electrode $A_i$ that corresponds to the turn-on discharge cells in the first row. Voltage $V_{scL}$ can equal voltage $V_{nf}$ as shown in the reset period in FIG. 2.

Accordingly, as given in Equation 2, voltage difference $V_{A\text{-}Y,address}$ between address electrode $A_i$ and scan electrode $Y_1$ in the discharge cell selected in the address period always becomes greater than the maximum discharge firing voltage $V_{f,MAX}$.

$$V_{A\text{-}Y,address}=V_{A\text{-}Y,reset}+V_a\geqq V_{f,MAX} \quad \text{[Equation 2]}$$

Therefore, address discharge is generated between address electrode $A_j$ and scan electrode $Y_1$ and between sustain electrode $X_1$ and scan electrode $Y_1$ in the discharge cell formed by address electrode $A_i$ to which a voltage of $V_a$ is applied and scan electrode $Y_1$ to which a voltage of $V_{scL}$ is applied. As a result, positive wall charges are formed on scan electrode $Y_1$ and negative wall charges are formed on sustain electrode X, and address electrode $A_i$.

Next, negative voltage $V_{scL}$ is applied to scan electrode $Y_2$ in the second row, and positive voltage $V_a$ is applied to address electrodes that correspond to the turn-on discharge cells in the second row. As in the first row, address discharge is generated and positive wall charges are formed on scan electrode $Y_1$ and negative wall charges are formed on sustain electrode $X_1$ and address electrode $A_i$. Continuing, voltage $V_{scL}$ is sequentially applied to scan electrodes $Y_3$-$Y_n$ in the residual rows, and voltage $V_a$ is applied to the address electrodes disposed on the turn-on discharge cells, thereby forming the wall charges.

In the sustain period, voltage $V_s$ is initially applied to scan electrodes $Y_1$-$Y_n$ and reference voltage 0V is applied to sustain electrodes $X_1$-$X_n$. The voltage between scan electrode $Y_j$ and sustain electrode $X_j$ exceeds the discharge firing voltage $V_{fxy}$ between the scan electrode and the sustain electrode in the discharge cell selected in the address period since the wall voltage caused by the positive wall charges of scan electrode $Y_j$ and the negative wall charges of sustain electrode $X_j$ formed in the address period are added to voltage $V_s$. Therefore, sustain discharge is generated between scan electrode $Y_j$ and sustain electrode $X_j$. Negative wall charges are formed on scan electrode $Y_j$ and positive wall charges are formed on sustain electrode $X_j$ of the discharge cells on which the sustain discharge is generated.

Next, 0V is applied to scan electrodes $Y_1$-$Y_n$ and voltage $V_s$ is applied to sustain electrodes $X_1$-$X_n$. As in the previous sustain discharge, the voltage between sustain $X_j$ and scan electrode $Y_j$ exceeds the discharge firing voltage $V_{fxy}$ between the scan electrode and the sustain electrode since the wall voltage caused by the positive wall charges of sustain electrode $X_j$ and the negative wall charges of scan electrode $Y_j$ formed in the previous sustain discharge are added to voltage $V_s$. Therefore, the sustain discharge is generated between scan electrode $Y_j$ and sustain electrode $X_j$, and the positive and negative wall charges are respectively formed on scan electrode $Y_j$ and sustain electrode $X_j$ of the discharge cells in which the sustain discharge is generated.

Continuing, voltage $V_s$ and 0V are alternately applied to scan electrodes $Y_1$-$Y_n$ and sustain electrodes $X_1$-$X_n$ to maintain the sustain discharge. The last sustain discharge is generated while voltage $V_s$ is applied to scan electrodes $Y_1$-$Y_n$ and 0V is applied to sustain electrodes $X_1$-$X_n$. The last sustain discharge is followed by a second subfield that starts from the above-noted reset period.

In a reset period of the second subfield, an auxiliary reset waveform is applied, and thus a ramp voltage that gradually falls from voltage $V_s$ to voltage $V_{nf}$ is applied after the last sustain pulse applied during the sustain period of the first subfield. Similar to the reset period of the first subfield, reference voltage 0V is applied to the address electrode A, and the sustain electrode X is biased with voltage $V_e$. The voltage applied to the scan electrode corresponds to the gradually falling ramp voltage applied in the reset period of the first subfield. Thus, weak discharges are generated on the discharge cells selected in the first subfield, and discharge is not generated on the discharge cells that are not selected. As a result, the wall charges formed between the scan electrodes and the address electrodes are eliminated in the reset period of the second subfield.

Since waveforms applied in the address and sustain periods to the second subfield correspond to the waveforms applied in the first subfields, a further description will not be provided. Further, waveforms applied in any of the third to eighth subfields may correspond to the waveform applied in the second subfield, and waveforms applied in any one of the third to eighth subfields may correspond to the waveform applied in the first subfield.

In the first embodiment of the present invention, the addressing is performed by allowing the voltage difference between the address and scan electrodes of the turn-on discharge cell in the address period to be greater than the maximum discharge firing voltage even if wall charges are not formed in the reset period. Hence, the problem of reduced margins may be ameliorated since the addressing is not influenced by wall charges formed in the reset period.

The circuit for driving the scan electrodes may be simplified since voltages $V_{scL}$ and $V_{nf}$ may be supplied by the same power source by making voltages of $V_{scL}$ and $V_{nf}$ equivalent.

In the first embodiment of the present invention, the reference voltage is established to be 0V, although it may be set to be other voltages. Where the difference between voltages $V_a$ and $V_{scL}$ is greater than the maximum discharge firing voltage, voltage $V_{scL}$ may be different from voltage $V_{nf}$.

Next, relations of discharge firing voltage $V_{fay}$ between the address electrode and the scan electrode, discharge firing voltage $V_{fxy}$ between the sustain electrode and the scan electrode, and voltage $V_s$ in the first embodiment will be described.

The discharge of the PDP is defined by the amount of secondary electrons generated when the positive ions collide with the cathode, referred to as a γ process. Accordingly, the discharge firing voltage when the electrode covered with matter of a high secondary emission coefficient γ is operated as the cathode is less than the discharge firing voltage when the electrode is covered with matter of a low secondary electron emission coefficient γ. In a 3-electrode PDP, the address electrode formed on a rear substrate is covered with a phosphor for representation of colors, and the scan electrode and the sustain electrode formed on a front substrate are covered with a film which has a high secondary electron emission coefficient γ such as MgO. The scan electrode and the sustain electrode are symmetrically formed since they possess the same secondary emission coefficient. However, the address electrode and the scan electrode are asymmetrically formed since they possess different secondary emission coefficients. Thus, the discharge firing voltage between the address electrode and the scan electrode varies depending on whether the address electrode is operated as an anode or a cathode.

That is, discharge firing voltage $V_{fay}$ when the address electrode covered with a phosphor is operated as an anode and the scan electrode covered with a dielectric layer is operated as a cathode is less than discharge firing voltage $V_{fy'a}$ when the address electrode is operated as a cathode and the scan electrode is operated as an anode. The relation of discharge firing voltage, $V_{fay}$, between the address electrode and the scan electrode, and discharge firing voltage $V_{fxy}$ between the scan electrode and the sustain electrode satisfies Equation 3. The relation is variable according to states of the discharge cells.

$$V_{fay}+V_{fy'a}=2V_{fxy} \quad \text{[Equation 3]}$$

Since the scan electrode operates as a cathode during the falling ramp voltage in the reset period and the address period, discharge firing voltage $V_{fay}$ between the address electrode and the scan electrode is given as Equation 4 from Equation 3. Since a sustain discharge is not to be generated in the discharge cells which are not addressed in the address period, voltage $V_s$ is less than discharge firing voltage $V_{fxy}$.

$$V_{fay}<V_{fxy} \quad \text{[Equation 4]}$$

$$V_s<V_{fxy} \quad \text{[Equation 5]}$$

Since the wall voltage between the address electrode and the scan electrode is set to be about 0V during the reset period in the first embodiment, a discharge is not consecutively generated between the scan electrode and the address electrode and between the sustain electrode and the address electrode during the sustain period. Consecutive generation of discharge occurs when voltage $V_s$ is applied to the scan electrode, resulting in a discharge between the scan electrode and the address electrode. As a result of the discharge, positive walls charges accumulate to the sustain electrode, and when voltage $V_s$ is applied to the sustain electrode, discharge is generated between the sustain electrode and the address electrode. Since the sustain electrode and the scan electrode are symmetrical, the discharge firing voltage between the sustain electrode and the address electrode corresponds to voltage $V_{fay}$. Thus, voltage $V_{fay}$ should be greater than $V_s/2$, as given in Equation 6, so that a discharge does not occur when voltage $V_s$ is applied after the positive wall charges are formed on the sustain electrode due to the discharge between the scan electrode and the address electrode.

$$V_s-V_{fay}<V_{fay}$$

$$V_{fay}>V_s/2 \quad \text{[Equation 6]}$$

From Equations 4, 5, and 6, voltage $V_{fay}$ can be near voltage $V_s$ since voltage $V_{fay}$ is greater than voltage $V_s/2$ and voltages $V_{fay}$ are $V_s$ are less than voltage $V_{fxy}$. This relation is given as Equation 7. The value of ΔV may be between 0V to 30V.

$$V_s/2<V_{fay}=V_s\pm\Delta V \quad \text{[Equation 7]}$$

In FIG. 2, voltage $V_e$ applied to the sustain electrodes $X_1$-$X_n$, in the reset and address periods has been illustrated as a positive voltage. Voltage $V_e$ may be varied if a discharge may be generated between scan electrode $Y_j$ and sustain electrode $X_j$ by the discharge between scan electrode $Y_j$ and address electrode $A_i$ in the address period. For example, voltage $V_e$ may be 0V or a negative voltage.

The voltage applied to the address electrode during the reset period has been described to be 0V in the above-described embodiments. Since the wall voltage between the address electrode and the scan electrode is determined by the difference of the voltages applied to the address electrode and the scan electrode, the voltages applied to the address electrode and the scan electrode may by set differently when the difference of the voltage applied to the address electrode and the scan electrode satisfies the relations that correspond to the embodiments.

The ramp pattern voltages have been described to be applied to the scan electrode during the reset period in the embodiments, and in addition, other patterns of voltages for generating a weak discharge and controlling the wall charges may be applied to the scan electrode. Levels of the other patterns of voltages are gradually varied according to time variation.

The problem of reduced margins due to loss of wall charges is ameliorated since the addressing is not influenced by the wall charges formed in the reset period. Additionally, the contrast ratio of the display is enhanced since discharge cells not selected in the first subfield do not discharge during the reset periods.

In a general PDP, one frame is divided into a plurality of subfields and then driven, and grayscales are expressed by combinations of the respective subfields.

Light of a subfield with a weight value of 1 for expressing a minimum gray scale (unit of light) is given as a sum of light generated in the reset period, light generated in the selected discharge cell, and light generated when one sustain discharge is generated during the sustain period. The subfield with weight value of 1 that expresses grayscale 1 may be represented by address light generated by the address discharge and sustain light generated by the sustain discharge.

However, since performance of expressing low grayscales is increased when at least a minimum discharge is generated in the subfield which represents minimum gray scales, a rising ramp waveform is applied as a sustain-discharge pulse during the sustain period of the subfield.

Figure 4:
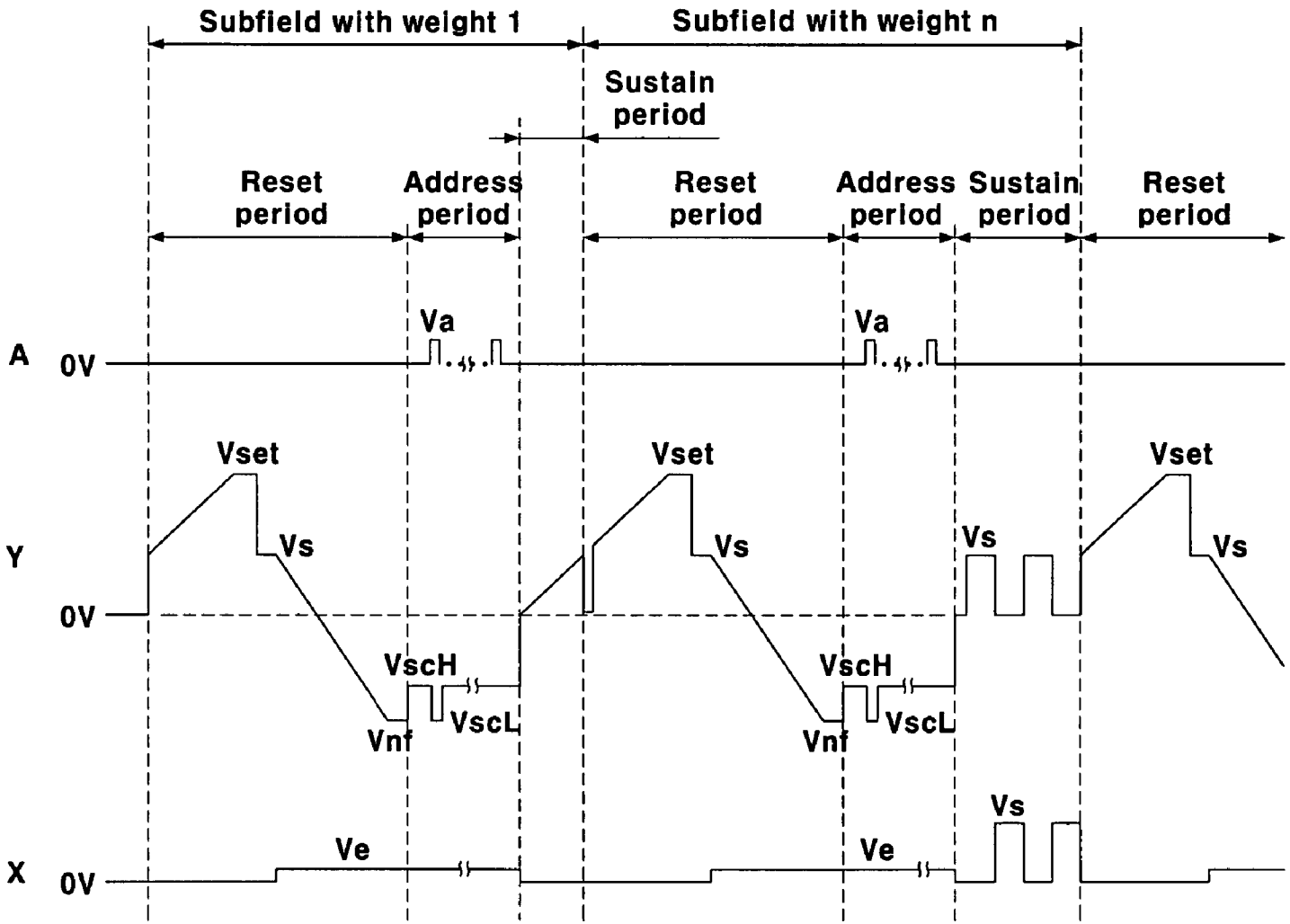
FIG. 4 shows a driving waveform diagram of a plasma display device according to a second embodiment of the present invention.

FIG. 4 shows a driving waveform diagram of a subfield with weight value of 1 of a PDP according to a second embodiment of the present invention.

Wall charges formed on the scan electrode, the sustain electrode, and the address electrode are eliminated in the reset period. When negative voltage $V_{scL}$ is applied to the scan electrode and voltage $V_a$ is applied to the address electrode during the address period, positive (+) wall charges accumulate to the scan electrode and negative (−) wall charges accumulate to the address electrode. When a pulse that rises to a sustain discharge voltage is applied during the sustain period, the wall voltage between the scan electrode and the address electrode becomes high and thus the discharge is generated between the scan electrode and the address electrode.

Since the scan electrode and the sustain electrode are covered with the MgO film and the address electrode is covered with the phosphor, a secondary electron emission coefficient of the address electrode is lower than those of the scan electrode and the sustain electrode. Therefore, the discharge is delayed beyond the time that the rising ramp waveform exceeds discharge firing voltage between the scan electrode and the address electrode. Since a voltage at discharge is greater than the discharge firing voltage, a strong discharge may be generated between the scan electrode and the address electrode. Thus, it is difficult to efficiently reduce the sustain light.

Therefore, the sustain discharge for subfield with weight value of 1 can be generated between the sustain electrode and the scan electrode before the sustain discharge is generated between the address electrode and the scan electrode when a sustain discharge pulse in a rising ramp pattern is applied.

Figure 5:
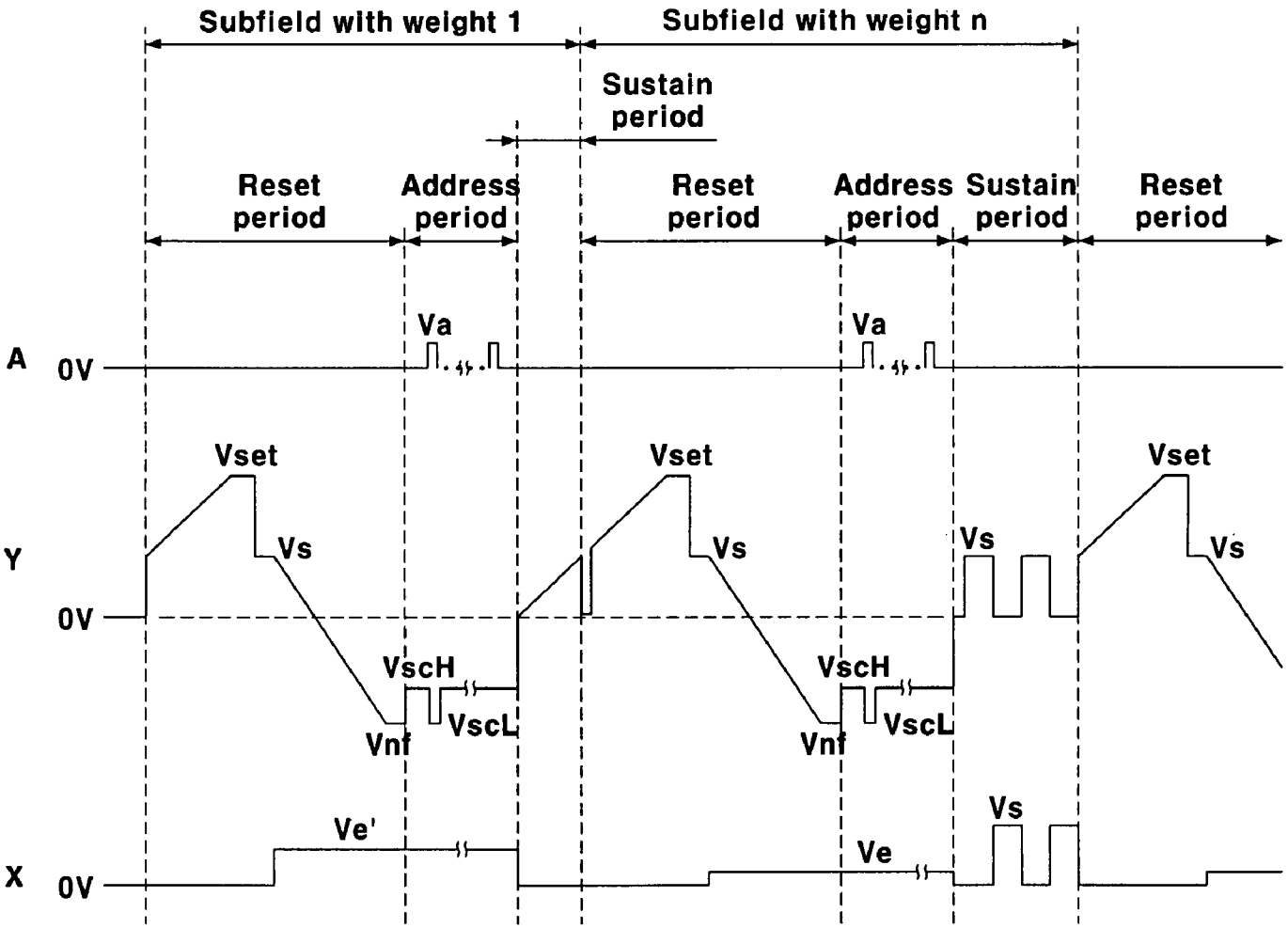
FIG. 5 shows a driving waveform diagram of a plasma display device according to a third embodiment of the present invention.

FIG. 5 shows a driving waveform diagram of a subfield with weight value 1 of a PDP according to a third embodiment of the present invention.

As shown in FIG. 5, voltage $V_{e'}$ is applied to a sustain electrode in a sustain falling reset period and an address period of a subfield with weight value 1. Voltage $V_{e'}$ is greater than voltage $V_e$ applied to a sustain electrode in a sustain falling reset period and an address period of a subfield with weight value of n (n is equal to or greater than 2) according to the third embodiment of the present invention.

At the reset period finishing point of the subfield with weight value of n, wall charges formed on the sustain electrode, the scan electrode, and the address electrodes are eliminated. However, voltage $V_{e'}$ applied to the sustain electrode is greater than voltage $V_e$ in the reset period of the subfield with weight value of 1. Since a voltage difference between the sustain electrode and the scan electrode at the reset period finishing point of the subfield with weight value of 1 is greater than a voltage difference between a sustain electrode and a scan electrode at the reset period finishing point of other subfields, negative (−) wall charges accumulate to the sustain electrode and positive (+) wall charges accumulate to the address electrode at the reset period finishing point.

In the address period, when voltage $V_a$ is applied to the address electrode and voltage $V_{scL}$ is applied to the scan electrode of a turn-on discharge cell, address discharge is generated and thus a small amount of negative wall charges accumulate to the address electrode and the sustain electrode and a large amount of positive wall charges accumulate to the scan electrode.

However, since negative wall charges accumulate to the sustain electrode at the reset period finishing point, an increased amount of negative wall charges accumulate at the address period finishing point. Thus, negative wall charges accumulate to the sustain electrode at a greater level when a sustain discharge pulse of $V_{e'}$ is applied in the subfield with weight value of 1 than when voltage $V_e$ is applied to the sustain electrode in the reset and address periods of the subfield with weight value of n.

Accordingly, the increased levels of negative and positive wall charges form on the sustain electrode and the scan electrode, respectively. When a rising sustain waveform is applied in the sustain period as shown in FIG. 5, the wall charges boost the voltage difference between the sustain electrode and scan electrode as compared to a conventional waveform, and the discharge is generated between the sustain electrode and the scan electrode before the discharge is generated between the address electrode and the sustain electrode. Additionally, since the secondary electron emission coefficients of the sustain electrode and the scan electrode are higher than the secondary electron emission coefficient of the address electrode, discharge delay time shortens and a milder discharge is generated during the sustain period.

Therefore, the sustain light of the subfield with weight value of 1 is reduced, and a total amount of light is reduced thereby increasing the performance of expressing low grayscales.

Since a driving waveform of the subfield with weight value of n is similar to the driving waveform of the first embodiment, a further description will not be provided.

However, it is preferable that a waveform applied during a reset period of a subfield that is next to the subfield with weight value of 1 can include a main reset waveform that gradually increases and gradually decreases. The reason is that the auxiliary reset waveform may not eliminate the wall charges because the amount of wall charges formed on the discharge cells has been increased at the address period finishing point by increasing a bias voltage of the sustain electrode in the reset and address periods of the subfield with weight value of 1. Therefore, applying the main reset waveform during the reset period may eliminate all the wall charges for the next address discharge.

Where address discharge is generated on the discharge cells when a voltage at the scan electrode is lower than a voltage at the sustain electrode in the address period, the wall voltage of the scan electrode becomes higher than that of the sustain electrode. In addition, negative and positive wall charges accumulate to the address electrode and the scan electrode, respectively, at the reset period finishing point. When the address discharge is generated, a potential difference between the scan electrode and the sustain electrode becomes greater than the potential difference when voltage $V_e$ is applied to the sustain electrode. Therefore, a strong discharge may be generated early in the sustain period between the sustain electrode and the scan electrode when the wall voltage is high.

Figure 6:
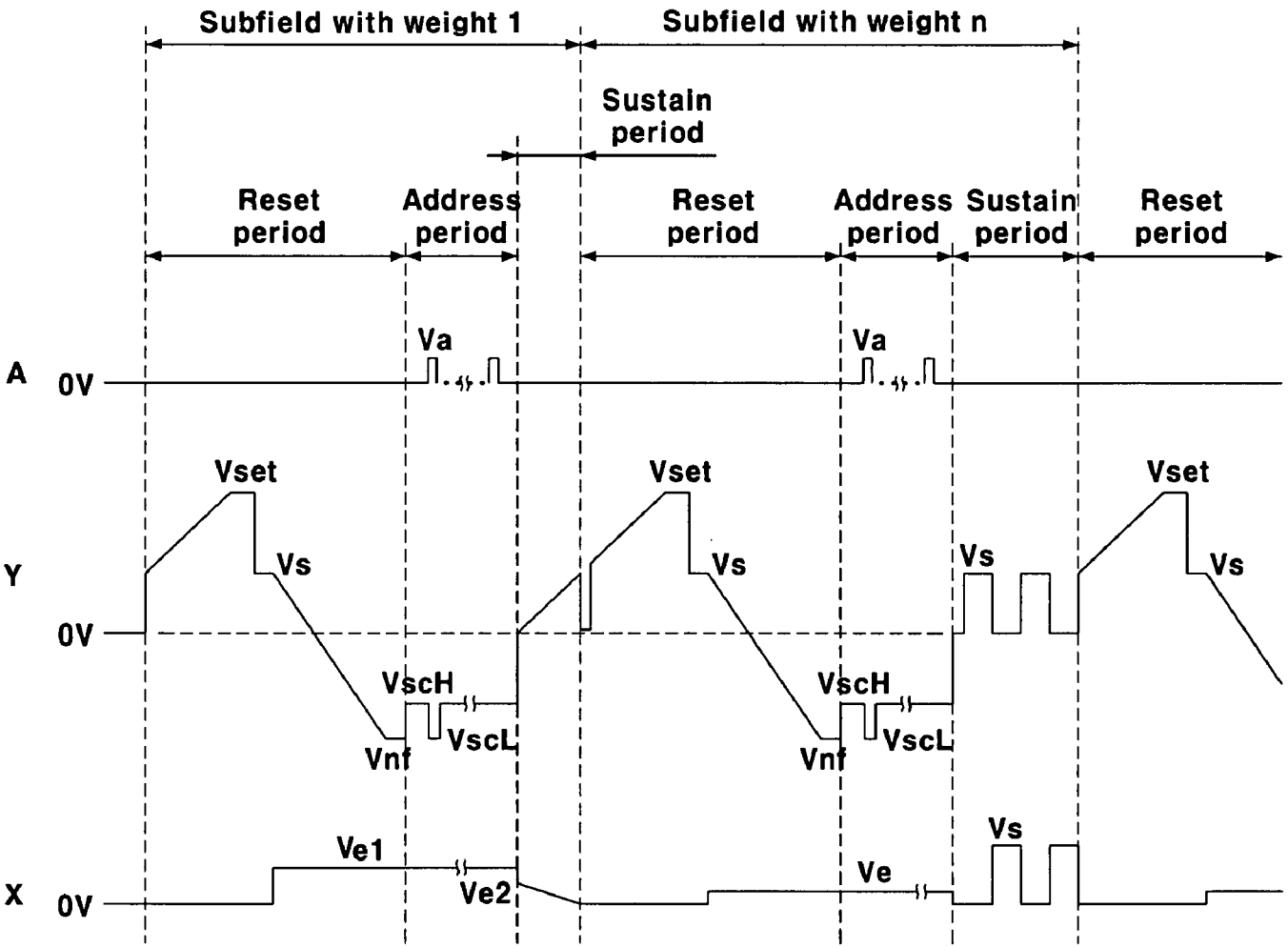
FIG. 6 shows a driving waveform diagram of a plasma display device according to a fourth embodiment of the present invention.

In a fourth embodiment of the present invention, a voltage of the sustain electrode is set to positive voltage $V_{e2}$ when a ramp pattern sustain pulse is applied to the scan electrode in the sustain period of the subfield with weight value of 1, as shown in FIG. 6. The voltage at the sustain electrode is set to be greater than a voltage at the scan electrode. As a result, a potential difference between the sustain electrode and the scan electrode is reduced, thereby preventing generation of a strong discharge between the sustain electrode and the scan electrode in the early stage of the sustain period.

In addition, since the unit of light needs to be generated to express at least gray scale 1 and the wall charges in the discharge cell need to be ready for the next reset waveform at the sustain period finishing point, the voltage of the sustain electrode may gradually decrease to the ground voltage in a ramp pattern as the voltage of the scan electrode rises, as shown in FIG. 6.

However, this increases the manufacturing cost because an additional circuit is required to apply the waveform of FIG. 6 that gradually decreases the voltage from $V_{e2}$ to 0V in the sustain electrode.

Figure 7:
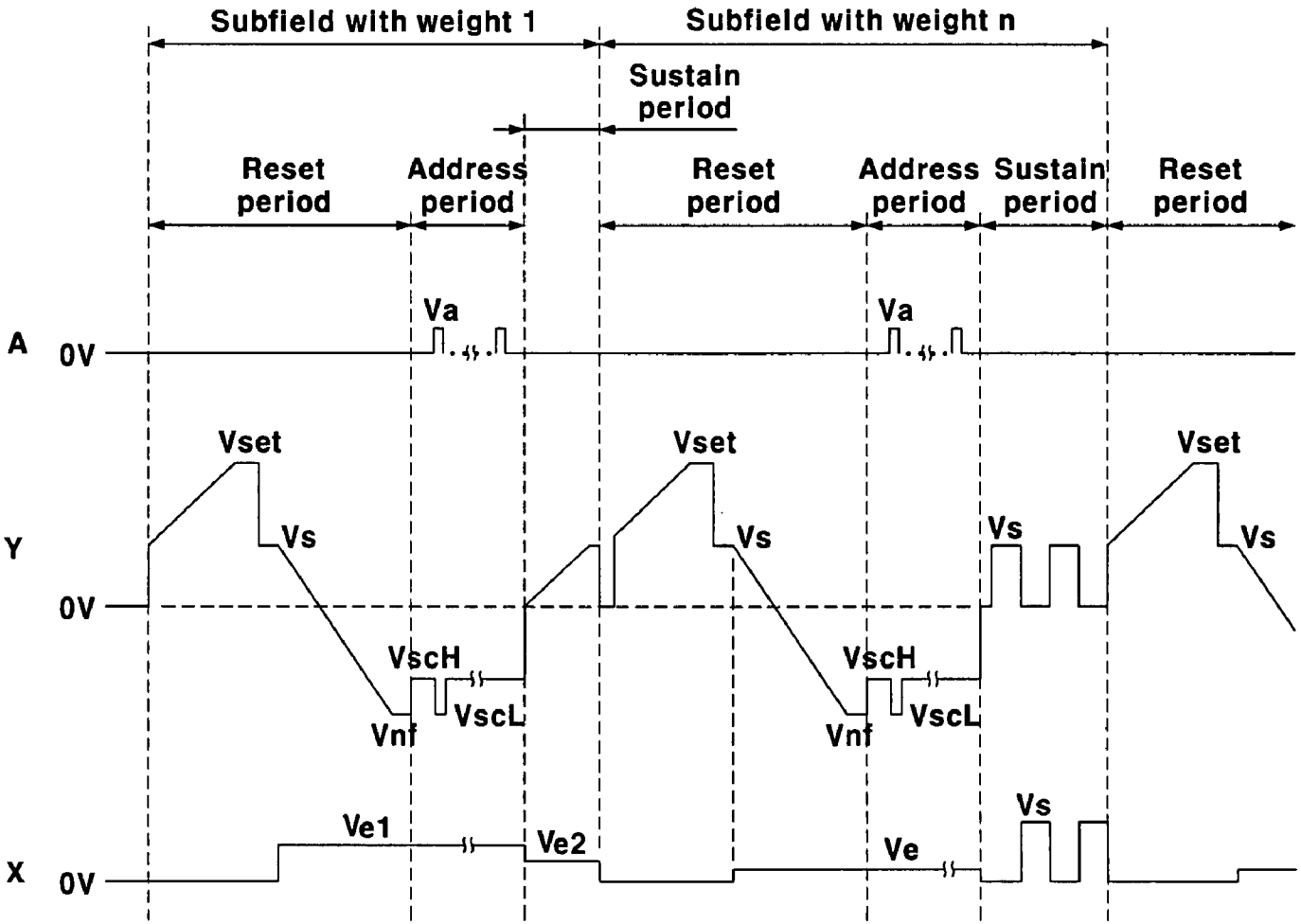
FIG. 7 shows a driving waveform diagram of a plasma display device according to a fifth embodiment of the present invention.

Therefore, in a fifth embodiment of the present invention, as shown in FIG. 7, the sustain electrode is biased with voltage $V_{e2}$ in the sustain period while the voltage at the scan electrode is gradually increased to voltage $V_s$. The voltage at the sustain electrode is then biased with 0V after gradually increasing the voltage at the scan electrode to $V_{set}$. As a result, the sustain discharge is generated between the scan and sustain electrodes while preventing misfiring at the early stage of the sustain period and without installing an additional circuit for applying the ramp waveform to the sustain electrode.

In the fourth and the fifth embodiments, voltage $V_{e2}$ is set to be lower than voltage $V_{e1}$, but voltage $V_{e2}$ may be set to correspond to voltage $V_{e1}$ to reduce the number of power sources. In addition, voltage $V_{e2}$ may be set to a minimum voltage applied to the sustain electrode and the scan electrode in the sustain period.

In addition, although only two stages are shown, a bias voltage of the sustain electrode may be reduced through more than two stages.

According to the fifth embodiment of the present invention, when the sustain waveform is applied to the sustain electrode during the sustain period of the subfield with weight value of 1, the sustain electrode is maintained at positive voltage $V_{e2}$ and the address electrode is biased with 0V.

Thus, the voltage difference between the scan electrode and the address electrode is greater than the voltage difference between the scan electrode and the sustain electrode. Accordingly, a discharge generated between the scan electrode and the address electrode may be stronger than a discharge generated between the scan electrode and the sustain electrode.

Since the address electrode is covered with a phosphor, the secondary electron emission coefficient of the address electrode is lower than that of the sustain electrode. As a result, a strong discharge may be generated between the scan electrode and the address electrode when the rising ramp waveform is applied as a sustain discharge pulse.

Figure 8:
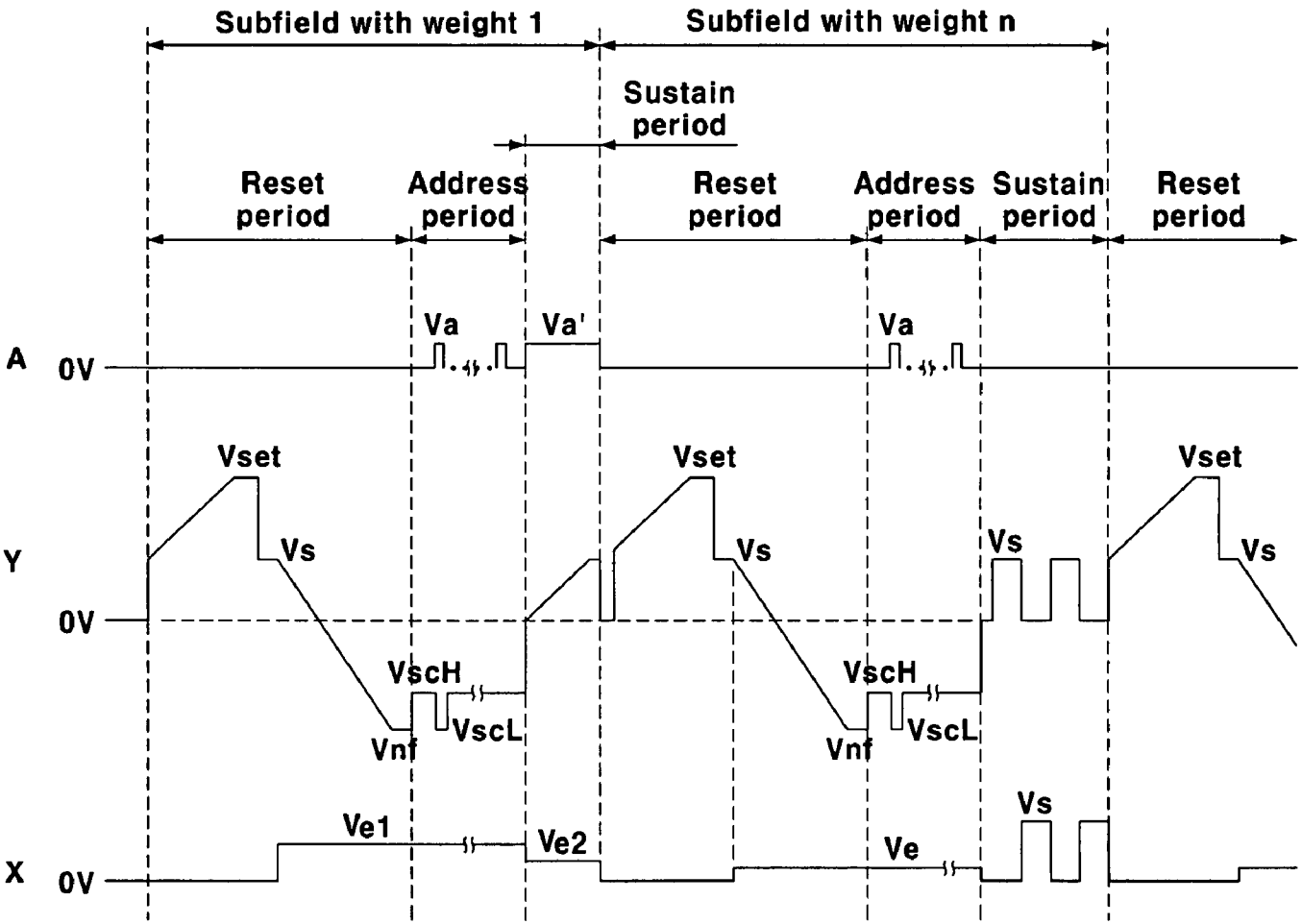
FIG. 8 shows a driving waveform diagram of a plasma display device according to a sixth embodiment of the present invention.

In a sixth embodiment of the present invention, the sustain electrode is maintained at positive voltage $V_{e2}$ and the address electrode is applied with positive voltage $V_{a'}$ when the sustain waveform is applied to the scan electrode during the sustain period of the subfield with weight value of 1, as shown in FIG. 8. Voltage $V_{a'}$ may be set to be greater than voltage $V_e$ so as to make a voltage difference between the scan electrode and the address electrode smaller than that of between the scan electrode and the sustain electrode. In addition, voltage $V_{a'}$ may be set to correspond to voltage $V_a$ to thereby reduce the number of power sources.

In the second to sixth embodiments, the voltage of the scan electrode is reduced to the ground voltage after the gradually rising sustain discharge pulse is applied during the sustain period of the subfield with weight value of 1. The reset waveform that gradually rises from voltage $V_s$ to voltage $V_{set}$ is then applied again during the reset period of the subfield with weight value of n. However, separate ramp switches are required when applying two ramp waveforms.

Figure 9:
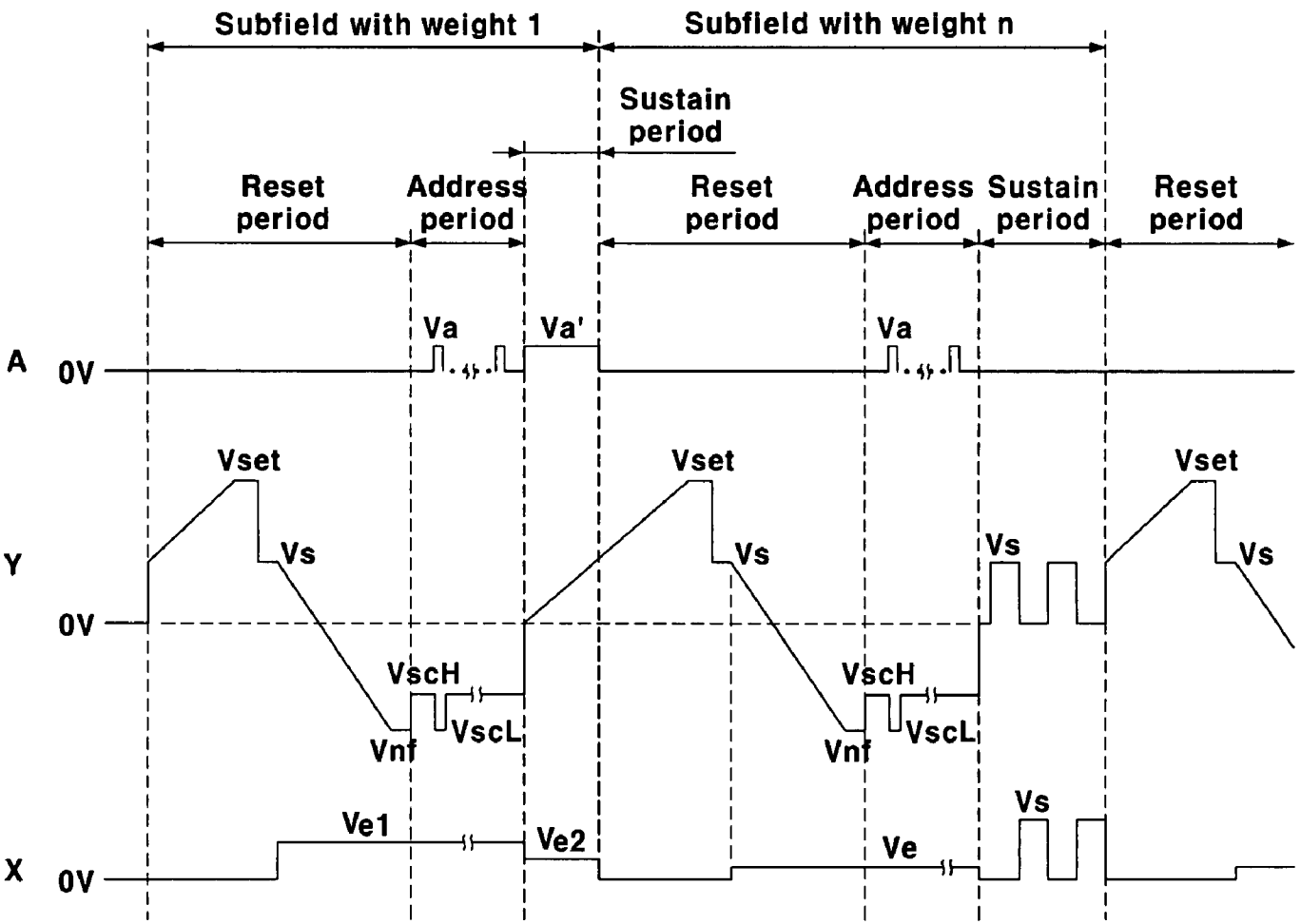
FIG. 9 shows a driving waveform diagram of a plasma display device according to a seventh embodiment of the present invention.

A driving method that does not require an additional ramp switch is provided in FIG. 9 according to a seventh embodiment of the present invention.

In the seventh embodiment, the reset waveform that gradually rises from voltage $V_s$ to voltage $V_{set}$ may be applied in the reset period of the subfield with weight value of n without reducing the voltage to the ground voltage after applying the gradually rising sustain discharge pulse during the sustain period of the subfield with weight value of 1, as shown in FIG. 9. Therefore, only one ramp switch is operated.

In the sixth and seventh embodiments, the address electrode is biased with voltage $V_{a'}$ during the sustain period of the subfield with weight value of 1, but it may be partially biased with voltage $V_{a'}$ during the sustain period. As a result, when the sustain discharge pulse in a rising ramp pattern is applied, the voltage difference between scan electrode and the address electrode becomes smaller that that of between the scan electrode and the sustain electrode, and thus a discharge is generated between the scan electrode and the sustain electrode before a discharge is generated between the scan electrode and the address electrode. In addition, since the sustain electrode and the scan electrode have high secondary electron emission coefficients, a discharge delay time becomes short and thus generation of a strong discharge is prevented.

In the sixth and seventh embodiments, the sustain electrode can be biased at positive $V_{e2}$ during the sustain period of the subfield with weight 1. However, the voltage at the sustain electrode during the sustain period may also be gradually reduced as described in the fourth embodiment while applying a positive voltage $V_{a'}$ to the address electrode.

According to the embodiments of the present invention, the problem of reduced margins through loss of wall charges may be ameliorated since the addressing is not influenced by the wall charges formed in the reset period.

In addition, the performance of expressing low grayscales may be increased by increasing the bias voltage applied to the sustain electrode during the falling reset period, the address period, and the sustain period of the subfields that express low grayscales.

In addition, the performance of expressing low grayscales may be further increased by biasing the address electrode with a positive voltage during the sustain period of the subfields that express low grayscales.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A driving method of a plasma display device by a plurality of subfields divided from a frame, the plasma display device having a plurality of first electrodes, a plurality of second electrodes, and a plurality of address electrodes that form discharge cells, and expressing gray scales by using combinations of subfields with respective weight values, the plurality of subfields being grouped into first and second groups of subfields with the first group of subfields comprising a subfield of a minimum weight value, the driving method comprising the steps of, in the first group of subfields:

gradually reducing a voltage at the first electrode from a first voltage to a second voltage, during a reset period;

applying at least one scan pulse to an electrode selected from the plurality of first electrodes, and simultaneously applying an address voltage to an address electrode of a discharge cell to be selected from among discharge cells applied with the scan pulse, during an address period;

gradually increasing the voltage of the first electrode from a third voltage to a fourth voltage, in a sustain period; and applying a pulse of a fifth voltage to the address electrode for at least a partial period during which the voltage of the first electrode is gradually increased from the third voltage to the fourth voltage.

2. The driving method of claim 1, further comprising:

during the sustain period, gradually reducing the voltage at the second electrode to, or biasing with, a voltage lower than that applied to the second electrode in the address period.

3. The driving method of claim 1, wherein a voltage applied to the second electrode during an address period of a subfield in the second group is lower than a voltage applied to the second electrode during an address period of a subfield in the first group.

4. The driving method of claim 3, wherein the fifth voltage equals the address voltage.

5. The driving method of claim 3, further comprising:

applying a negative voltage to the first electrodes among the plurality of first electrodes that are not applied with the scan pulse in the address period.

6. The driving method of claim 3, wherein the second voltage is less than a negative value of half the difference between voltages applied to the first electrode and the second electrode for sustain discharge in the sustain period.

7. The driving method of claim 3, wherein the second voltage is approximately equal to a negative value of a difference between voltages between the first electrode and the second electrode applied for sustain discharge in the sustain period.

8. A plasma display device, comprising:

a plasma display panel having a plurality of first electrodes, a plurality of second electrodes, and a plurality of third electrodes crossing the plurality of first electrodes and the plurality of second electrodes to form discharge cells;

a controller dividing a frame into a plurality of subfields having respective weight values and grouping the subfields into a first group and a second group such that the first group comprises a subfield of a minimum weight value; and a driver gradually reducing a voltage difference between the first and second electrodes from a first voltage to a second voltage, during a reset period of each subfield, the voltage difference being obtained by subtracting a voltage of the second electrode from a voltage of the first electrode, and wherein the driver gradually increases said voltage difference from a third voltage to a fourth voltage, during a sustain period of said first group, and wherein said driver biases a voltage at the third electrode with a positive fifth voltage for at least a partial period during which the voltage difference is gradually increased from the third voltage to the fourth voltage.

9. The plasma display device of claim 8, wherein an absolute value of the voltage difference at said second voltage for said first group is greater than an absolute value of the voltage difference at said second voltage for said second group.

10. The plasma display device of claim 9, wherein the driver discharges turn-on discharge cells among discharge cells by applying the fifth voltage to the third electrode, during an address period.

11. The plasma display device of claim 9, wherein the driver gradually increases a voltage at the first electrode from a sixth voltage to a seventh voltage and gradually reduces a voltage at the second electrode from an eighth voltage to a ninth voltage simultaneously during a sustain period of said first group.

12. The plasma display device of claim 11, wherein the driver applies a voltage to the second electrode in an address period in said second group that is lower than the voltage applied to the second electrode in an address period in said first group.

13. The plasma display device of claim 9, wherein the voltage applied to the second electrode during the address period of the subfield in the second group is equal to or greater than the eighth voltage.

14. The plasma display device of claim 9:

wherein the driver gradually reduces a voltage difference between the first and third electrodes from a tenth voltage to an eleventh voltage, during a reset period of each subfield, and wherein said eleventh voltage is less than a negative value of half of a difference between voltages of the first electrode and the second electrode applied for sustain discharge in the sustain period.

15. The plasma display device of claim 14, wherein said eleventh voltage is about equal to the negative discharge voltage difference between the first and third electrodes.

* * * * *

UNITED STATES PATENT AND TRADEMARK OFFICE

CERTIFICATE OF CORRECTION

PATENT NO. : 7,580,050 B2
APPLICATION NO. : 11/255868
DATED : August 25, 2009
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 933 days.

Signed and Sealed this

Fourteenth Day of September, 2010

David J. Kappos

David J. Kappos
*Director of the United States Patent and Trademark Office*